United States Patent [19]

Faren

[11] 4,047,182

[45] Sept. 6, 1977

[54] DAMPENING GUARD FOR TV ANTENNAS

[76] Inventor: Jack Faren, 12 Manito Ave., Oakland, N.J. 07436

[21] Appl. No.: 724,842

[22] Filed: Sept. 20, 1976

[51] Int. Cl.[2] ..... H01Q 13/00

[52] U.S. Cl. ..... 343/904; 174/42; 188/1 B; 343/DIG. 1

[58] Field of Search ..... 343/DIG. 1, 904; 174/42; 188/1 B

[56] References Cited

U.S. PATENT DOCUMENTS 3,188,644 6/1965 Sielaff ..... 343/DIG. 1

*Primary Examiner*—Alfred E. Smith
*Assistant Examiner*—David K. Moore
*Attorney, Agent, or Firm*—Ralph R. Roberts

[57] ABSTRACT

This invention pertains to a new and inexpensive apparatus for inhibiting vibrations of existing or to be installed antennas such as are provided for use with VHF, UHF, FM and the like. These antennas include a longitudinal metal rail or spine from which transverse tubular elements extend. Usually these elements are pivotally held on one end of this spine. In and with a snapping action these elements are swung into extending position and are secured in detents formed in the spine. When in the desired transverse orientation the tubular elements are secured on this spine member. High winds as they pass by or buffet the mounted antenna tend to vibrate these elements. When the duration of vibration is prolonged one or more of the elements often break off. The loss of one or more elements affects the efficiency and effectiveness of this antenna. Replacement of these missing or broken elements is often difficult and expensive. The present invention provides an inexpensive device to inhibit such vibrations and includes a tubular plastic member which is secured to like oppositely disposed elements by plastic hook-like members. This plastic beam at its midlength has a threaded aperture formed to receive and retain a plastic screw which is turned to bring the extending or inner end of the screw into engagement with the longitudinal spine of the antenna. As this screw is turned, it brings the secured metal tubular elements into a tensioned condition. The element guard extends between midlength of the metal tubular elements as the screw engages the longitudinal spine of the antenna.

14 Claims, 7 Drawing Figures

DAMPENING GUARD FOR TV ANTENNAS

BACKGROUND OF THE INVENTION

1. Field of the Invention

With reference to the classification of art as established by the United States Patent Office the present invention is believed to be found in the general class entitled, "Communications, Radio Wave" (Class 343) and more particularly in the subclass entitled, "antennas - combined with diverse art device" (subclass 720) and in the subclass entitled, "combined" (subclass 904).

2. Description of the Prior Art

The use of antennas for TV and FM reception is well known. For shipping convenience particularly, the providing of a folding antenna wherein the tubular elements are folded next to the spine is very popular. Such folded antennas are, of course, a development of more than twenty years. Particularly with the advent of the do-it-yourself installer it has become well known to provide the concept of an antenna which is pre-folded for boxing and shipping and which is then expanded to its use condition at the time of installation. Several of these metal tubular elements are normally secured to a longitudinal member and are pivotally attached at one end. When swung into their transverse position they are retained by means of a detent or a similar device formed on the longitudinal support or spine. These tubular elements may be of three-eighths, one half or similar inches in diameter. No matter the diameter these elements extend outwardly as much as six or seven feet more-or-less at right angles to the longitudinal support. In mounted condition the elements have a tendency to vibrate during a period of high wind velocity. The continued vibration of these elements causes a fatiguing of the metal which eventually develops into a crack and the breaking off of these antenna elements from their mounted condition on the longitudinal member.

Prior to this invention dampening attempts have been made in which the elements are stiffened or reinforced or a sonic clamp or weight is used to prevent vibration of these elements at a harmonic frequency. In the present apparatus reinforcement of the elements is not required and whether or not a harmonic frequency is achieved is primarily a matter of happenstance. The present vibration dampener includes a rectangular tubular plastic member having its ends closed. The tubular plastic member is of a determined length. Near the ends of this plastic member are attached hook-like members preferably also plastic which are adapted to slide upon and retain the metal tube providing the signal collecting elements of the antenna. Midway of this rectangular plastic tube is a plastic screw bolt wherein a threaded portion is mounted in a threaded aperture formed in this plastic rectangular support. In use the two hook-like members of plastic are secured to the like metal elements extending from the same portion of the spine element of the antenna. The bolt at the midpoint of this transverse plastic member is turned to bring the center of the plastic bolt into contact with the spine or longitudinal metal member of the antenna. This bolt is tightened into position until the two extending transverse metal tubular elements are brought into desired tension. The tensioning inhibits these metal tubular elements from vibrating when a high wind passes over and by said metal elements of the antenna. This dampening device prevents oscillation or vibration of the elements which tend to cause a rupture of the metal and breaking of the elements.

SUMMARY OF THE INVENTION

This invention may be summarized at least in part with reference to its objects.

It is an object of this invention to provide, and it does provide, a dampening apparatus which is attached to like-extending elements of a TV, FM or like antenna. The midportion of each extending metal tubular element is brought into tensioned engagement of the carrying spine of the antenna. The center portion of the plastic member is moved by a screw to cause the dampening and elements to be brought into a desired tensioned condition.

It is a further object of this invention to provide, and it does provide, a dampening apparatus which is made of inexpensive plastic. The element securing members are plastic hangers having U-shaped hook-like ends. These members are secured to a rigid plastic tube of a determined length. This tube has its midportion threaded to receive a plastic bolt or non-conductive bolt which is screwed into position against the carrying spine of the antenna. The adjusted turning of this bolt causes the hook members to move the elements of the antenna into a determined tension.

In brief, the component provided by this invention includes a round or rectangular plastic tube which referably is closed at both ends. At and on each end there is carried a hanger member which may be of plastic. The open ends of these hanger members are slidable on and are secured on the metal elements of the antenna. Midlength of these hangers this tubular plastic member is threaded to receive a plastic covered or plastic bolt. This bolt is turned to an extent sufficient to bring the engaged plastic hangers having hook-like ends and the metal tubular elements of the TV antenna into a tensioned condition so that vibration of these elements are dampened.

In addition to the above summary the following disclosure is detailed to insure adequacy and aid in understanding of the invention. This disclosure, however, is not intended to prejudice that purpose of a patent which is to cover each new concept no matter how it may later be disguised by variations in form or additions of further improvements. For this reason there has been chosen a specific embodiment of the antenna dampening apparatus as adapted for use on TV, FM and the like antennas and for installation thereof. This specific embodiment has been chosen for the purpose of illustration and description as shown in the accompanying drawing wherein:

Figure 1:
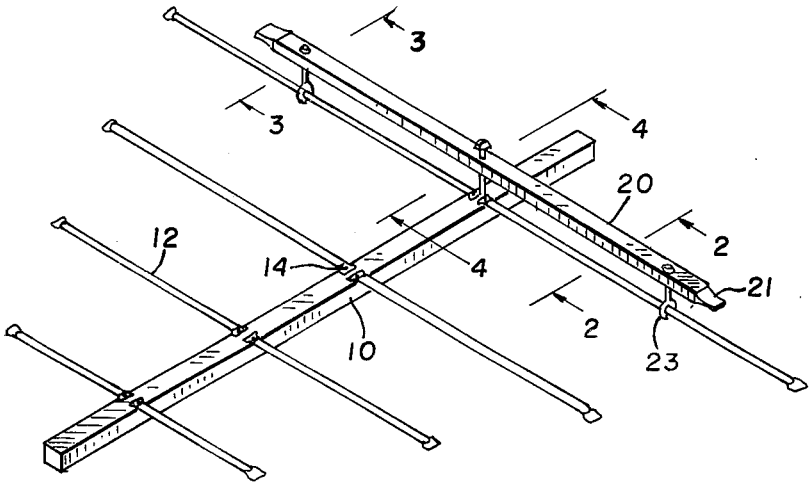
FIG. 1 represents an isometric view of a typical antenna and showing in particular a dampening device of this invention as placed in position to dampen vibrations on one pair of signal collecting elements, these elements being brought into a determined tension and condition and being representative of the other pairs of elements when dampeners are applied thereto.
Figure 2:
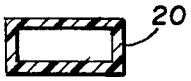
FIG. 2 represents a sectional view taken on the line 2—2 of FIG. 1 and showing in an enlarged scale a preferred rectangular, tubular construction of a transverse bar forming a part of a dampening apparatus.

In the following description and in the claims various details will be identified by specific names for convenience. These names, however, are intended to be generic in their application. Corresponding reference characters refer to like members throughout the seven figures of the drawings. The drawing accompanying this specification discloses certain details of construction for the purpose of explanation of the invention and the invention may be incorporated in other structural forms than shown.

DESCRIPTION OF THE PREFERRED EMBODIMENT

Referring now to the drawing and in particular to FIGS. 1 through 4, it is to be noted that item 10 pertains to an antenna support or spine which is conventionally a U-shaped or rectangular tubular member. This member usually is the supporting spine or a portion of the spine for the antenna and is attached to the mast in a conventional manner, not shown. This longitudinal support conventionally carries a plurality of aluminum, tubular elements generally identified as 12. These tubular elements are of varying lengths but conventionally are arranged in a ladder-like progression upon the member 10. Each element is secured at one end as by a rivet or bolt 14. The elements are swung into position at the time of installation of the antenna. Conventionally there are retaining means formed on the member 10 into which these elements 12, when they are swung or positioned in the desired transverse orientation, are secured into this position by means of U-shaped detents or other means provided by the member 10. This is conventional as a means for retaining an end. The orientation of the tubular elements 12 may be achieved or provided in a number of conventionally known ways. After the antenna has been mounted and the elements 12 have been swung into a transverse orientation position, the longitudinal support 10 is secured to the mast, not shown, by straps or U-bolts and the like. The present invention is now utilized to provide a dampening effect of vibrations on one pair of the metal, tubular elements 12 when the antenna is buffeted by high velocity winds.

Figure 3:
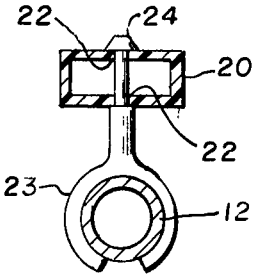
FIG. 3 represents a sectional view taken on the line 3—3 of FIG. 1 and showing in an enlarged scale a plastic, hanger securing retainer as carried by the plastic, rectangular, tubular bar in which the hanger retainer is open at the bottom and is retained in place by riveting the stem end, the hanger having its element retaining end sized to slidably engage the aluminum tubular element of the antenna.
Figure 4:
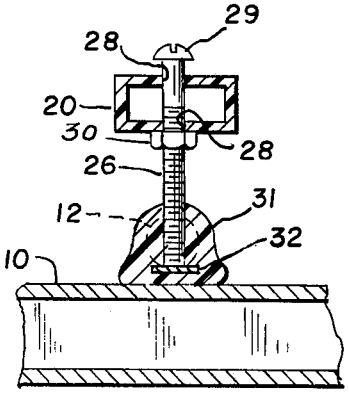
FIG. 4 represents a sectional, partly fragmentary view as taken on the line 4—4 of FIG. 1 and showing in an enlarged view the relationship of the transverse plastic bar and the metal spine or rail of the antenna and the transverse tubular element carrying a round head bolt and nut with the end engaging the spine or rail of the antenna carrying an insulating cap member.
Figure 5:
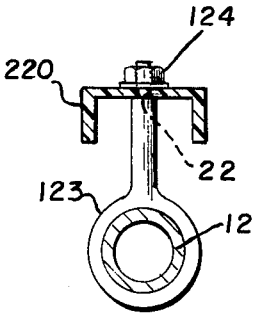
FIG. 5 represents in an enlarged scale the securing retainer of FIG. 3 but with the hanger end being a closed loop and the stem having a threaded end on which is mounted a nut by which the hanger is secured to the transverse member.

As seen in the several FIGURE, the dampening device includes a plastic, tubular, transverse member 20 which preferably is of a rectangular or round tubular configuration. Both ends are preferably closed at 21 to prevent the entry into and retention in the interior of this tubular member of moisture, snow, ice and the like. This rectangular or round tubular member or element 20 has a pair of like-size apertures 2 formed near its ends in which are mounted plastic hanger retainers 23. These plastic hangers having hook-like ends are contemplated as being molded. Each tubular, metal element 12 is retained by end of hanger 23 which may be a partial circular member, as shown in FIG. 3, or may be fully closed at the bottom, as seen in FIG. 5. The method of constructing the hanger retainer 23 is merely a matter to be determined by the manufacturer of the antenna dampener. The upper portion of each hanger retainer 23 has a securing member 24. This member 24 may be a mushroom riveting of the end of the stem or may be a threaded fastener whichever is desired or selected by the manufacturer of the element guard. A mushroom rivet 24 formed on the stem of the hanger 23 is shown in FIG. 3 while an alternate construction is shown in FIG. 5 wherein a hanger 123 has a threaded stem end and is retained in the apertures 22 in transverse member 120 by a nut 124. Midway of these plastic hangers 23 is a plastic screw 26 which may have a slot for a screwdriver. If desired, this screw may be a thumb screw member adapted for manual manipulation. This screw extends through an aperture 28, as seen in FIG. 4. As shown in FIG. 4, the bolt 26 may be of metal and having a round head 29 in which there may be a screwdriver slot. A nut 30 carried on the threaded stem of the bolt engages the underside of member 20 to urge and retain the member 20 in the tensioned condition. A pad or bumper member 31 is attached to the end of bolt 26 and is of a non-conducting material such a rubber or plastic. A stop washer 32 is conventionally mounted in a receiving hole formed in the pad and prevents the unwanted displacement of the pad up the stem or the screw as it is tightened into the desired tension.

Figure 6:
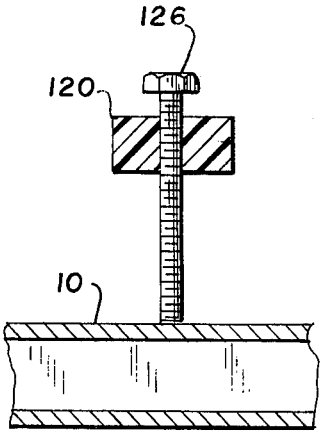
FIG. 6 represents in a like enlarged scale the transverse bar and the metal spine, as shown in FIG. 4, but with the bolt being of a non-conducting material such as plastic, and having a hex head.

In FIG. 6, a bolt 126 is carried in threaded portions 127 in the transverse member 220 and has a hex head. This bolt is of a non-conducting material such as plastic which is turned to bring the stem into the desired relationship with the transverse member.

Figure 7:
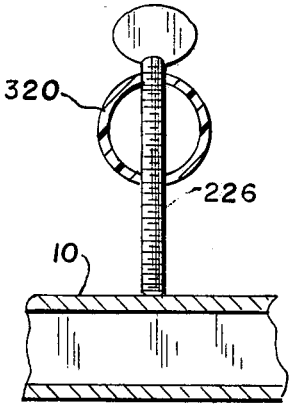
FIG. 7 represents in a like enlarged scale the transverse bar and metal spine, as shown in FIG. 4, but with a non-conductor screw member such as plastic and having a thumb head or end, said screw mounted in a round rather than a rectangular tubular extrusion.

In FIG. 7, the bolt or screw 226 is a thumb screw preferably of a non-conducting material such as plastic. No matter the material of the bolt or screw the turning is intended to bring a depicted round, tubular tensioning member 320 and the hangers 23 into a tension condition whereby the secured and retained tubular elements 12 are caused to be brought into a tensioned condition.

As seen in FIG. 1, it is to be noted that a dampening bar 20 and two hangers 23 are used with the longer pair of elements 12. This is merely representative as a dampening apparatus is to be used with each pair of elements. As these elements conventionally are made progressively shorter in TV antennas the tubular bar 20 and the hanger members carried thereby are made correspondingly closer together and shorter. The dampening device may be provided on the upper portion above the spine member of the antenna or may be provided below the spine member as determined by the construction and mounting of the elements 12 as they are secured to the spine 10. It is desirable that an excessive application of force is not applied to the tubular elements 12 as mounted to the member 10. It is also to be noted that in certain antennas the elements 12 are retained in an offset manner. When this occurs the swivel action provided by the hangers 23 allows a self-aligning condition to occur whereby an offset condition of the elements 12 is accommodated. The offset condition of the elements when and as it occurs is usually either in a longitudinal manner or in a verticle manner. In either and any arrangement the bar 20, attached hangers 23 and the screw member 26 accommodate any offset condition with no decrease in the efficiency of the element guard.

Whether the member 20 is made out of a rectangular or a round tube is merely a matter of preference and it is contemplated that this member may be made a U-shaped or a solid plastic extrusion, as desired. The preferred construction, as shown, is a rectangular extruded tube. This tubing is cut to a desired length and the ends of the tubing are closed at 21 to prevent interior moisture from accumulating. The screw member 26 may be a metal member or may be a metal screw coated with plastic as selected by the maker of the dampening device. As the plastic conductor 20 is a non-conductor of electrical TV signals, the screw 26 may be metal. However, because of the possibility of moisture on the tubular member 20 and the conductive problems of such a conductor the screw is preferably made of plastic or plastic coated. Whether the screw is adjusted by a screwdriver, the fingers or a pair of pliers is merely a matter of selection. The securing of hangers 23 to members 20 by means of nuts 124 or by a riveting or swaging of the end of the stem portion is merely a matter of preference or convenience. The length of the plastic member 20 and the position of the hangers 23 in and on member 20 is a matter of selection. It is contemplated that only two or three different lengths of dampeners may be required to achieve the desired placing and positioning of the element guards upon the various lengths of the pair of metal elements of the antenna.

Although the tubular member 20 is contemplated to be of a non-conducting material such as plastic, it is recognized that this member may be of metal if the hangers 23 and the screw 26 are of a non-conducting material. The potential inductance provided by making the member 20 of metal is not desirable, hence, is not recommended as a preferred construction. The making of the entire element guard of plastic which is electronically inert is both inexpensive and retains the efficiency of the mounted antenna. No matter the selection of the materials for the element guard, it is necessary that the effectiveness of the antenna be maintained and that the element guard inhibit the wind induced vibrations in the metal elements. The illustrated apparatus provides this service as well as assisting in maintaining the desired alignment of the elements of the antenna.

In FIG. 5, the transverse member is shown as a channel configuration identified as 220. in FIG. 6, the transverse member is shown as a solid extrusion identified as 120. The round transverse tubular member depicted in FIG. 7 is identified as 320.

Terms such as "left", "right", "up", "down", "bottom", "top", "front", "back", "in", "out" and the like are applicable to the embodiment shown and described in conjunction with the drawing. These terms are merely for the purposes of description and do not necessarily apply to the position in which the element guard for antennas may be constructed or used.

While a particular embodiment of the element guard has been shown and described it is to be understood that modifications may be made within the scope of the accompanying claims and protection is sought to the broadest extent the prior art allows.

What is claim is:

1. An element guard dampening apparatus for attachment to the extending metal transverse signal collecting elements of the antenna such as is used for TV and FM and collecting such signals as VHF, UHF and FM, said dampener engaging and reducing to an extent the destructive effect caused by vibrations of the metal elements carried by a spine, said vibrations developing as the result of high winds, said element guard apparatus including: (a) a transverse member which is adapted to be placed adjacent oppositely disposed metal signal collecting elements of an antenna and to extend at least to the midlength of each element; (b) a pair of hanger element retainers, each retainer having one end secured to the transverse member and an opposite hook-like end sized and adapted to slide on and retain the extending metal collecting elements of the antenna, said hangers secured to the transverse member so as to permit the transverse member to extend from said one collecting element to the oppositely disposed collecting element mounted to the spine portion of the antenna, and (c) a screw mounted and turnable in a threaded aperture of the transverse member, the element guard in a mounted condition having an end of the screw in engagement with the spine of the antenna and when the screw is turned inwardly the transverse member and the attached hanger retainers are moved vertically to bring the metal tubular signal collecting elements into a tensioned condition whereby wind induced vibrations are inhibited, and the components forming the element guard are sufficiently non-conductive so that the received electrical signals of and by the said elements are unaffected by the presence of the mounted element guard.

2. An antenna element guard as in claim 1 in which the transverse member is of non-conducting plastic.

3. An antenna element guard as in claim 2 in which the transverse member is a rectangular plastic extrusion.

4. An antenna element guard as in claim 2 in which the extrusion is tubular and the ends are closed to prevent the entry of moisture into the interior thereof.

5. An antenna element guard as in claim 2 in which the transverse member is a round tubular member.

6. An antenna element guard as in claim 2 in which the transverse member is of a channel configuration.

7. An antenna element guard as in claim 2 in which the transverse member is a solid extrusion.

8. An antenna element guard as in claim 1 in which the hanger element retainers are of non-conducting plastic.

9. An antenna element guard as in claim 8 in which the hanger element retainers are moldings and a stem portion thereof is secured in an aperture formed in the transverse member, said stem being secured by a mushroom-type rivet at the end of the stem.

10. An antenna element guard as in claim 8 in which the hanger element retainers are moldings and a stem portion thereof is secured in an aperture formed in the transverse member, said stem being secured by a nut which is rotatably mounted on a threaded end portion of the stem and is tightened to retain the element retainer in the desired orientation.

11. An antenna element guard as in claim 1 in which the screw which is mounted in the transverse member is of non-conducting plastic.

12. An antenna element guard as in claim 11 in which the screw has a screwdriver slot provided in the head portion.

13. An antenna element guard as in claim 11 in which the head portion is formed as a thumb screw end providing for manual and plier manipulation.

14. An antenna element guard as in claim 1 in which the screw which is mounted in the transverse member is plastic coated at least as to the spine engaging end.

* * * * *